United States Patent [19]

Clements

[11] 4,263,730

[45] Apr. 28, 1981

[54] FILAMENT-TYPE ATTACHMENT DEVICE WITH LABEL AND METHOD OF MANUFACTURE

[75] Inventor: Alan Clements, Tappan, N.Y.

[73] Assignee: Ben Clements & Sons, Inc., S. Hackensack, N.J.

[21] Appl. No.: 867,409

[22] Filed: Jan. 6, 1978

[51] Int. Cl.[3] ..... G09F 3/08

[52] U.S. Cl. ..... 40/20 R

[58] Field of Search ..... 40/2 R, 21 R, 20 R, 40/22, 2.2; 292/22, 307 A

[56] References Cited

U.S. PATENT DOCUMENTS

| | | | |
|---|---|---|---|
| 1,359,951 | 11/1920 | Behrman | 40/20 R |
| 2,517,376 | 8/1950 | Artzt et al. | 40/20 R |
| 3,402,435 | 9/1968 | Merser | 40/20 R X |
| 3,429,064 | 2/1969 | Davi | 40/20 R |
| 3,444,597 | 5/1969 | Bone | 40/20 R |
| 3,462,864 | 8/1969 | Merser | 40/2 R |
| 3,765,110 | 10/1973 | Olsen | 40/20 R |
| 3,785,337 | 1/1974 | Flowerday | 40/21 R X |

FOREIGN PATENT DOCUMENTS

| | | | |
|---|---|---|---|
| 2558952 | 12/1975 | Fed. Rep. of Germany | 40/20 R |
| 1009684 | 11/1965 | United Kingdom | 40/20 X |

*Primary Examiner*—Gene Mancene
*Assistant Examiner*—Wenceslao J. Contreras
*Attorney, Agent, or Firm*—Blum, Kaplan, Friedman, Silberman & Beran

[57] ABSTRACT

A filament-type attachment device with a label formed from a stretch oriented thermoplastic material is provided. The attachment device includes a filament formed with a label engaging portion at its first end and a cross-bar joined to a second end of the filament, and a label formed with a receiving portion adapted to receive the engaging portion of the filament. The label and engaging portion are formed to facilitate securing the label and resist removal from the filament.

16 Claims, 4 Drawing Figures

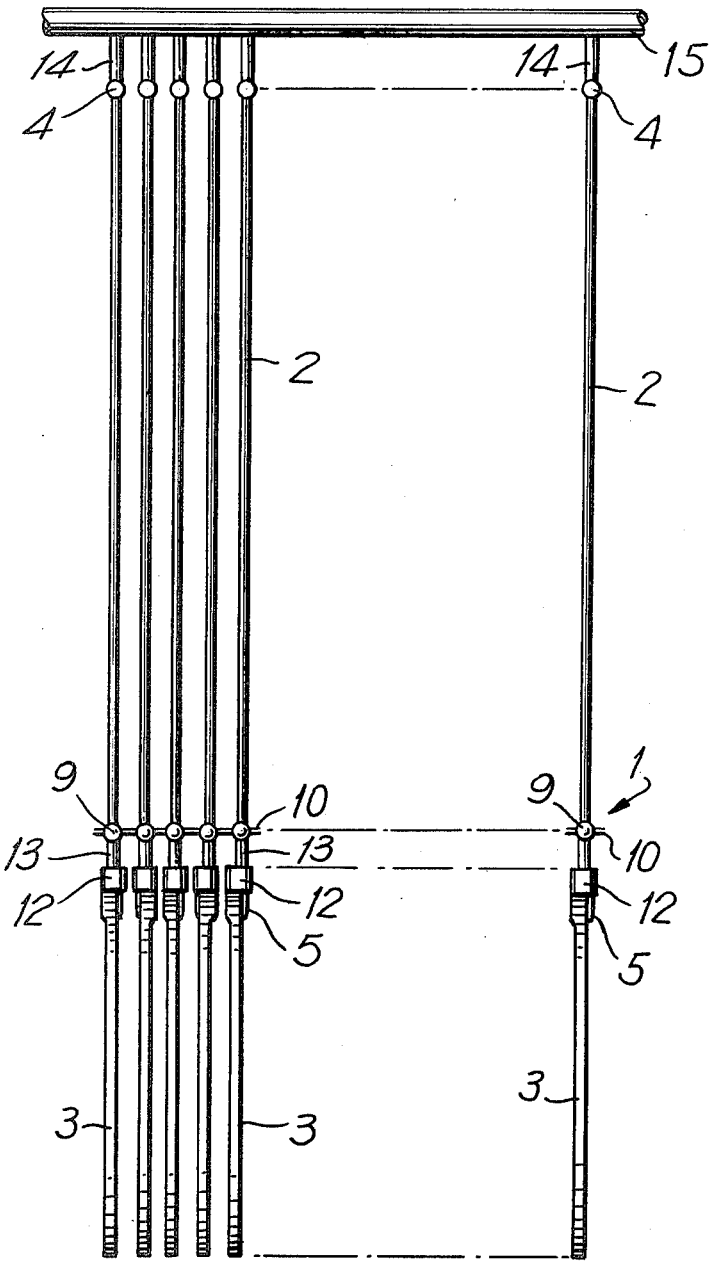
FIG. 1
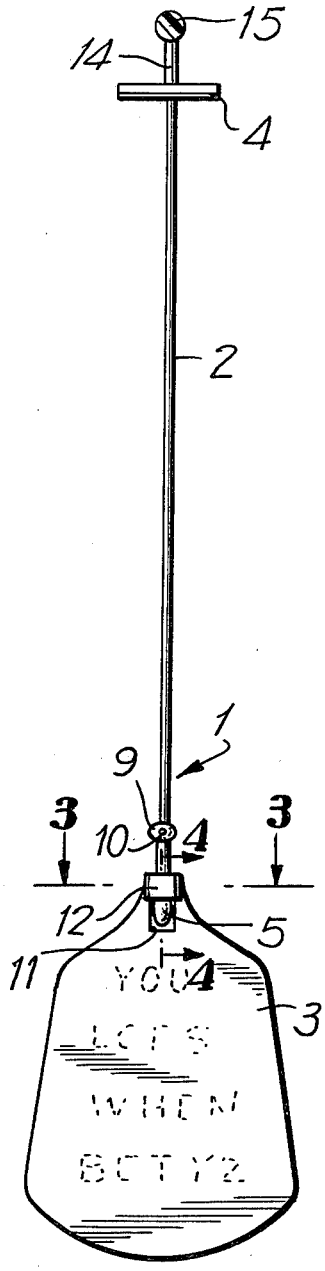
FIG. 2
FIG. 3
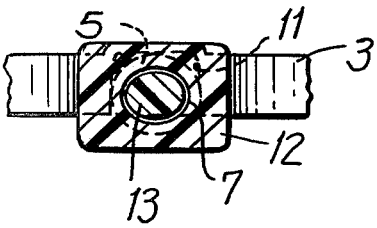
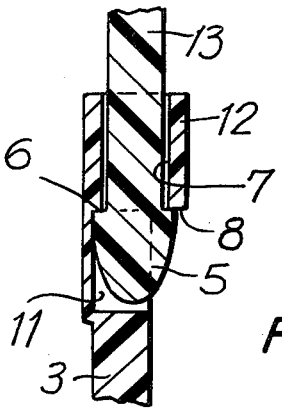
FIG. 4

FILAMENT-TYPE ATTACHMENT DEVICE WITH LABEL AND METHOD OF MANUFACTURE

BACKGROUND OF THE INVENTION

This invention relates generally to a filament-type attachment device formed from a stretch oriented thermoplastic material, and particularly to an improved filament-type attachment device including a label. Filament-type attachment devices have been put into wide use for securing price and informational tags to garments and the like. In these conventional constructions the device is formed with a cross-bar at one end which is adapted to be inserted through a fabric and a wide paddle formed at the other end of the filament. A price tag is mounted on the cross-bar at the time of inserting the cross-bar into the garment fabric thereby preventing removal of the tag from the garment once the device is inserted.

It is often desirable to attach securely a message or promotional indicia on an attachment device wherein the label is secured to the attachment device. Accordingly, by providing a filament-type attachment device including a label for carrying a message which may be secured to a garment in a conventional manner, a message or other information may be presented to a customer.

SUMMARY OF THE INVENTION

Generally speaking, in accordance with the invention, a filament-type attachment device including a label secured to one end of a filament is provided. The device is formed from a stretch oriented thermoplastic material, such as polypropylene or nylon. The device includes a filament formed with a label engaging portion at its first end and a cross-bar joined to a second end of the filament and a securable label formed with a receiving portion adapted to receive the engaging portion of the filament and resist disengagement. The devices are formed by injection molding a plurality of connected filament portions which are stretched to orient the molecules of the filament and securing the labels thereon. Alternatively, the labels may be secured prior to stretching the filaments.

Accordingly, it is an object of the invention to provide an improved filament-type attachment device.

Another object of the invention is to provide an improved filament-type attachment device including a label secured thereto.

A further object of the invention is to provide an improved filament-type attachment device including a label integrally secured to one end of the filament.

Still another object of the invention is to provide an improved filament-type attachment device including a label which may be secured to the filament prior to or after stretching the filament.

Still a further object of the invention is to provide an improved method for manufacturing a filament-type attachment device including a label.

Still other objects and advantages of the invention will in part be obvious and will in part be apparent from the specification.

The invention accordingly comprises the several steps and relation of one or more of such steps with respect to each of the others, and the article possessing the features, properties, and the relation of elements, which are exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a side elevational view illustrating a series of attached filament-type attachment devices with labels constructed and arranged in accordance with an embodiment of the invention;

FIG. 2 is a front elevational view illustrating the filament-type attachment device with label depicted in FIG. 1;

FIG. 3 is a cross-sectional view taken along line 3—3 of FIG. 2 illustrating the engagement between the label and the filament; and FIG. 4 is a cross-sectional view taken along line 4—4 of FIG. 2 illustrating the attachment between the filament and label.

DESCRIPTION OF THE PREFERRED EMBODIMENTS

Referring to FIGS. 1 and 2, a filament-type attachment device with label is shown generally as 1. The attachment devices include a filament portion including a filament 2, a label 3 joined at a first end thereof and a cross-bar 4 formed at the second end of filament 2. FIG. 1 illustrates a plurality of attachment devices 1 which are unitarily molded into an assembly wherein each filament 2 is joined to a cross-bar 4 at its first end which is joined to a runner 15 by a gate 14. An assembly of attachment devices in accordance with the invention may be loaded into an attaching device of the type illustrated in U.S. Pat. No. 3,924,788 for the sequential attaching of each attachment device to a garment or the like by passing cross-bar 4 through a slotted hollow needle inserted in such garment. The attaching device would include knife means which cuts gate 14 to release each attachment device 1 for securing the associated label 3 to the garment. Filaments 2 are stretched to about 2 or 3 time the molded length to increase the tensile strength thereof. Labels 3 are secured to filaments 2 either prior to or after filaments 2 are stretched as will be described in more detail below.

In one embodiment of the invention, a plurality of filament portions of attachment devices 1 are molded from a nylon or polypropylene material with filaments 2 about one inch in length. A typical diameter of filaments 2 is between about 0.35 and 0.5 inches in diameter. Filament 2 is stretched to about 2.5 inches in length and between about 0.02 and 0.05 inches in diameter. Gates 14 are formed of a lesser diameter than cross-bar 4 in order to facilitate separation from filament 2 and cross-bar 4 when attachment device 1 is inserted into a fabric by a conventional inserting gun. The foregoing dimensions are by way of example and not by way of limitation.

Attachment device 1 is formed further with a nipple 9 at the second end of filament 2. A tapered filament head 5 is joined to nipple 9 by a filament 13, filament 13 preferably having a cross-sectional area greater than that of filament 2 for increased strength. The base 6 of tapered filament head 5 has a cross-sectional area greater than the cross-section area of filament 2. Filaments 2 may be joined to each other by a plurality of filament attachment gates 10 at the sides of nipples 9. Filament attachment gates 10 are formed thinly to facilitate separation of attachment devices 1 as each is attached. By constructing and arranging filaments 2 in this manner labels 3 may be secured easily either automatically or by hand either at the time filaments 2 are removed from the mold or after stretching.

Filaments 2 are stretched by clamping filaments 2 in the region proximate to cross-bar 4 and in the region proximate to nipple 9. Filaments 2 may be cold stretched and heated in a conventional manner in order to orient the molecules of the stretched thermoplastic material.

Label 4 is formed with a filament engaging portion including a filament receiving sleeve 12 formed with a filament receiving opening 7 dimensioned to receive filament 13 but so as to be smaller than head base 6, and a head receiving cavity 11 shaped to receive and cooperate with filament head 5. As tapered head 5 is inserted through opening 7 into head receiving cavity 11, the resiliency in collar 12 and head 5 permits its entry, but once inserted, head base 6 is engaged with the lower portion of collar 12 at surface 8 for preventing disengagement of filament 2 from label 3. In one embodiment of the invention, opening 7 is formed with a non-circular cross-section, such as an oval shape and filament 13 is similarly formed with an oval cross-section in order to prevent label from rotating about filament 2. In another embodiment of the invention, opening 7 and filament 2 are formed with circular cross-sections permitting the free rotation of label 3 about filament 2. In a further embodiment, filament 2 and label opening 7 are formed with rectangular cross-sections. The length of filament 13, determined by the spacing between nipples 9 and head 5, may be selected as desired. If desired, such length may be selected to substantially equal the width of collar 12 so as to tightly engage such collar.

After the filament portions of attachment device 1 are molded, filaments 2 are stretched to reduce their cross-sections in the region between cross-bar 4 and nipple 9. Stretching is stopped prior to the time filament 2 would break under tension. Stretching increases the flexibility of filament 2 and increases its tensile strength by orienting the molecules of the thermoplastic material. In one method, following stretching, filaments 2 are heated by hot air and cooled, resulting in a filament of increased tensile strength.

By providing filament attachment gates 10 between each adjacent filament 2, filament heads 5 are maintained in a relatively fixed position inasmuch as the portion of filament 2 between nipple 9 and head 5 has not been stretched and remains relatively rigid. Thus, when filament 2 is clamped in the region proximate nipples 9, filament heads 5 may be inserted easily into a series of labels 3 which have been aligned to receive heads 5. This insertion operation may be done prior to or after stretching filaments 2.

Accordingly, by providing labels 3 molded separately from filaments 2, labels 3 may be fixed to filaments 2 at the site of final use of attachment devices 1 or at the molding site. In this manner, various messages on labels 3 may be readily affixed to a series of stretched filaments 2 for insertion into a garment fabric. Messages or information carried on label 3 may be molded thereon or may be applied subsequently by printing or stamping. The devices offer a wide variety of uses including a retailer's identification, garment size, department, advertising, country of origin, price information or the like. A significant advantage over conventional label tags is obtained in that the attachment devices with labels may be easily applied by an automatic inserting gun which is used for inserting conventional filament-type attachment devices.

It will thus be seen that the objects set forth above, among those made apparent from the preceding description, are efficiently attained and, since certain changes may be made in carrying out the above method without departing from the spirit and scope of the invention, it is intended that all matter contained in the above description shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A filament-type attachment device including a label comprising:

a filament formed from a stretch oriented thermoplastic material;

a label engaging portion formed at a first end of said filament including a tapered head extending axially from the first end of said filament, said head formed with a base having a cross-sectional area greater that said filament;

a cross-bar joined to a second end of said filament intermediate the ends of said cross-bar; and a molded label formed with a filament engaging portion including an integrally molded sleeve lying parallel to the plane of said label for defining an opening dimensioned and formed to permit the resilient receipt of said tapered head when inserted through said opening but preventing withdrawal thereof, said label engaging portion engaged by said filament engaging portion of said label for securing said label to said filament and preventing the disengagement of said label from said filament.

2. The device of claim 1, wherein said filament is formed with a nipple proximate the first end of said filament for preventing said filament from passing through said opening formed in said label.

3. The device of claim 2, wherein the portion of said filament intermediate said tapered head and said nipple, and said opening in said label, are formed with non-circular cross-sections.

4. The device of claim 2, wherein said filament is stretched in at least a portion of the region thereof between said cross-bar and nipple to orient the molecules of said thermoplastic material for increasing the tensile strength of said filament.

5. The device of claim 4, wherein the thermoplastic material is nylon.

6. The device of claim 4, wherein said thermoplastic material is polypropylene.

7. The device of claim 2, wherein said label is formed with a sleeve defining said opening and a cavity adjacent the exit of said opening for receiving said head.

8. An assembly of the devices of claim 2, including a plurality of such devices, a runner and means releasably securing the cross-bar of each of said devices to said runner.

9. The device of claim 1, wherein said label is substantially planar and the edges of said label at the region of said filament engaging portion are tapered away from said head.

10. A filament-type attachment device including a label comprising:

a filament formed from a stretch oriented thermoplastic material;

a label engaging portion formed at a first end of said filament including a tapered head extending axially from the first end of said filament, said head formed with a base having a cross-sectional area greater than said filament and a nipple near the first end of said filament, the region of said filament between said nipple and said head formed with a non-circular cross-section;

a cross-bar joined to a second end of said filament intermediate the ends of said cross-bar; and a molded label formed with a filament engaging portion including an integrally molded sleeve defining a non-circular opening dimensioned and formed to permit the resilient receipt of said tapered head when inserted through said opening but not said nipple and preventing withdrawal of said head therefrom, said label engaging portion engaged by said filament engaging portion of said label for securing said label to said filament and preventing the disengagement of said label from said filament.

11. The device of claim 10, wherein said filament is stretched in at least a portion of the region thereof between said cross-bar and nipple to orient the molecules of said thermoplastic material for increasing the tensile strength of said filament.

12. The device of claim 10, wherein said thermoplastic material is nylon.

13. The device of claim 10, wherein said thermoplastic material is polypropylene.

14. The device of claim 10, wherein said label is formed with a cavity adjacent the exit of said sleeve opening for receiving said head.

15. An assembly of the devices of claim 10, including a plurality of such devices, a runner and means releasably securing the cross-bar of each of said devices to said runner.

16. The device of claim 10, wherein said label is substantially planar and the edges of said label at the region of said filament engaging portion are tapered away from said head.

* * * * *